US011731311B2

(12) United States Patent
Tarozzi

(10) Patent No.: US 11,731,311 B2
(45) Date of Patent: Aug. 22, 2023

(54) PROCESS AND EQUIPMENT FOR THE REALIZATION OF SLABS OF CERAMIC AND/OR STONE MATERIAL

(71) Applicant: SITI B&T GROUP S.p.A., Formigine (IT)

(72) Inventor: Fabio Tarozzi, Medolla (IT)

(73) Assignee: SITI B&T GROUP S.p.A., Formigine (IT)

( * ) Notice: Subject to any disclaimer, the term of this patent is extended or adjusted under 35 U.S.C. 154(b) by 243 days.

(21) Appl. No.: 17/260,843

(22) PCT Filed: Jul. 17, 2019

(86) PCT No.: PCT/IB2019/056107
§ 371 (c)(1),
(2) Date: Jan. 15, 2021

(87) PCT Pub. No.: WO2020/016797
PCT Pub. Date: Jan. 23, 2020

(65) Prior Publication Data

US 2021/0268686 A1 Sep. 2, 2021

(30) Foreign Application Priority Data

Jul. 18, 2018 (IT) ..... 102018000007275

(51) Int. Cl.
*B28B 1/00* (2006.01)
*B28B 13/02* (2006.01)

(52) U.S. Cl.
CPC ..... *B28B 1/005* (2013.01); *B28B 13/0295* (2013.01)

(58) Field of Classification Search
CPC ..... B28B 1/005; B28B 13/0295
See application file for complete search history.

(56) References Cited

U.S. PATENT DOCUMENTS 5,622,664 A * 4/1997 Uchida ..... B44C 1/26 264/122
5,662,847 A * 9/1997 Uchida ..... B29C 43/006 264/122
2017/0355101 A1* 12/2017 Toncelli ..... B28B 13/0295

FOREIGN PATENT DOCUMENTS

EP 0 558 248 A2 9/1993
WO WO 2005/090034 A1 9/2005
WO WO-2005090034 A1 * 9/2005 ..... B28B 1/005
WO WO 2016/113652 7/2016

* cited by examiner

*Primary Examiner* — Kelly M Gambetta
*Assistant Examiner* — Virak Nguon
(74) *Attorney, Agent, or Firm* — Aslan Law, P.C.

(57) ABSTRACT

A process for the realization of slabs of ceramic and/or stone material, including the following phases of: supplying at least one base material of the ceramic and/or stone type in the form of powder and/or granules and/or flakes; supplying at least one additional material of the ceramic and/or stone type in the form of powder and/or granules and/or flakes, different from the base material; delivering the base material onto a supporting surface to obtain a slab to be compacted having an initial thickness; pressing the slab to be compacted to obtain a compacted slab having a final thickness. Following the delivery and before the pressing, the following phases of: suctioning a portion of the base material to obtain at least one through groove which crosses the initial thickness along a determined path; and applying the additional material inside the groove.

8 Claims, 4 Drawing Sheets

Fig.4
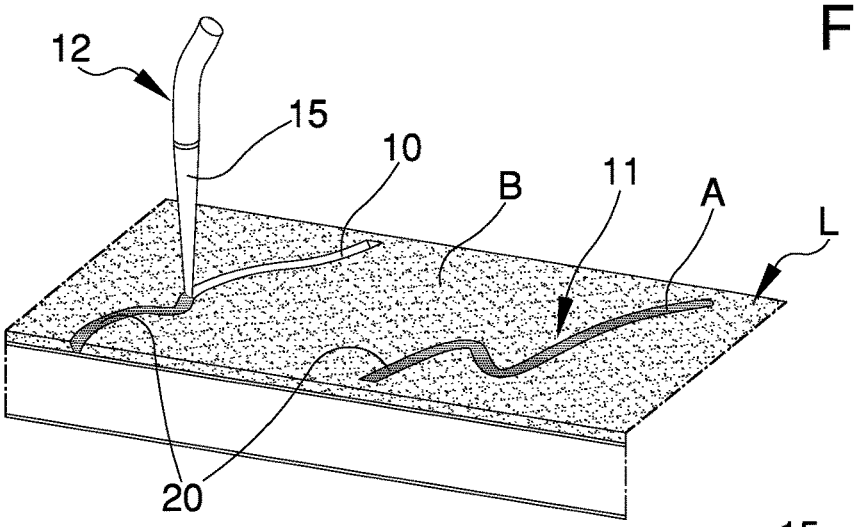
Fig.4a
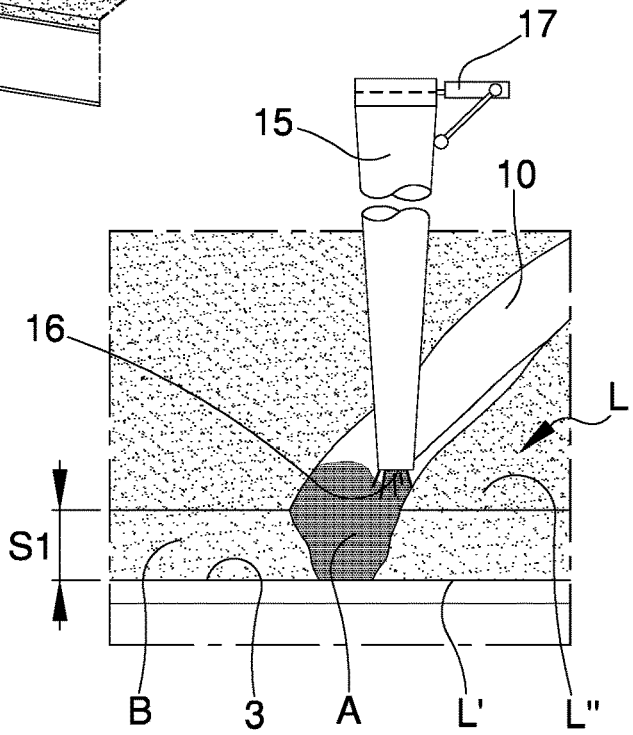
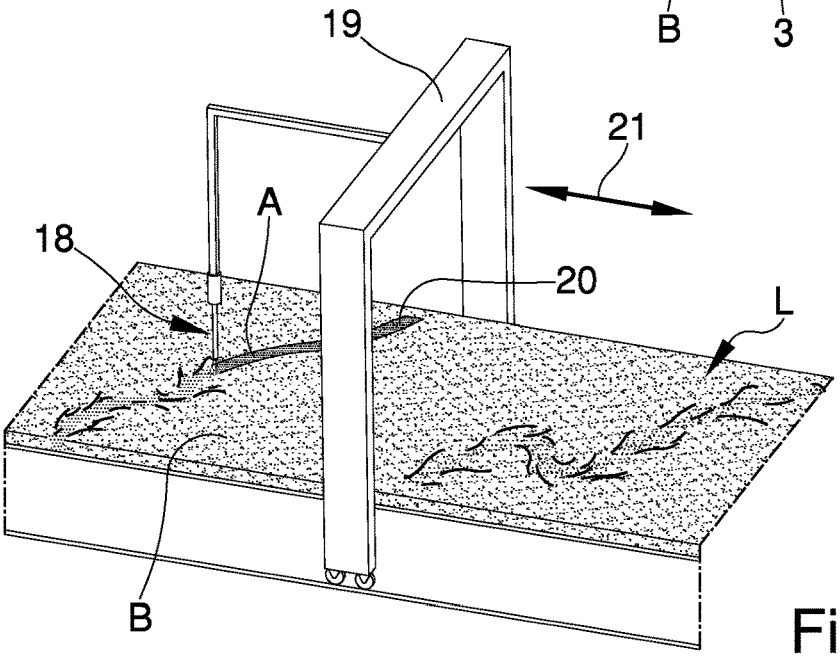
Fig.5

PROCESS AND EQUIPMENT FOR THE REALIZATION OF SLABS OF CERAMIC AND/OR STONE MATERIAL

CROSS-REFERENCE TO RELATED APPLICATIONS

This application is a National Stage Entry of PCT/IB2019/056107 filed on Jul. 17, 2019. This application claims priority to IT Patent Application No. 102018000007275 filed on Jul. 18, 2018, and to PCT Application No. PCT/IB2019/056107 filed on Jul. 17, 2019, the entire contents of which are hereby incorporated by reference.

TECHNICAL FIELD

The present invention relates to a process and equipment for the realization of slabs of ceramic and/or stone material.

BACKGROUND ART

The production of slabs made of ceramic and/or stone and/or lithoid material, such as mineral grit slabs bound with resins, generally involves a deposition phase of a base material, which may consist of a ceramic material or a mixture of minerals in granular form (e.g. marble, granite, glass, fragments of mirrors, and/or others) as well as quartz powder and, of course, resins that act as binders, on a supporting surface, such as a tape or a mold, to form a slab to be compacted, and a subsequent pressing phase, in order to obtain a compacted slab.

Depending on the type of base material, further phases are then carried out, such as e.g. firing and subsequent cooling, in order to obtain a product with high mechanical and chemical properties.

The equipment necessary to carry out these phases therefore includes the presence of a supporting surface, delivery means of the base material on the supporting surface so as to form a slab to be compacted and pressing means to obtain a compacted slab.

As the expert in the sector knows, depending on the type of base material used, the embodiment and the technical characteristics of the means that make up the relative equipment may change.

To date, the market requires increasingly special aesthetic effects, such as e.g. the reproduction of natural stones, like marble or granite, characterized by "veins", or strips with a wavy pattern of different color than the base material, which cross the entire thickness.

A well-known type of equipment used to obtain this effect involves the use of a hopper that extends over the entire width of the slab to be obtained and inside which the base material to be deposited on the supporting surface is loaded, a relative movement being envisaged between the latter and the hopper itself.

In order to obtain a "veined" effect, deposited inside the hopper are layers of different types of material, which are deposited in succession on the supporting surface.

The slabs obtained this way, however, have "longitudinal" veins, i.e. they do not cross the entire thickness of the slab. This drawback therefore prevents obtaining a so-called "through vein", typical of natural stones, and is particularly evident when slabs with two surfaces at right angles to each other have to be produced, as in the case of tops for kitchens, bathrooms or other similar applications, for which it is not possible to obtain a substantially continuous vein along the two surfaces at right angles to each other.

In addition, due to the friction of the material on the walls, the layers of material are not deposited evenly on the supporting surface, so that the intensity of the color of the veins obtained is faded.

DESCRIPTION OF THE INVENTION

The main aim of the present invention is to provide a process and equipment for the realization of slabs of ceramic and/or stone material which allows obtaining veins of the through type in a simple and reliable manner Within this aim, one of the objects of the present invention is to create aesthetic variations characterized by colors and/or designs not achievable using the natural materials mentioned above, thus making possible a particularly versatile and customizable production.

Another object of the present invention is to permit the reproducibility of the aesthetic effects obtained.

A further object of the present invention is to devise a process and equipment for the realization of slabs of ceramic and/or stone material which allows overcoming the aforementioned drawbacks of the prior art in a simple, rational, easy, effective to use and low cost solution.

The objects set forth above are achieved by the present process for the realization of slabs of ceramic and/or stone material according to claim 1.

The objects set forth above are achieved by the present equipment for the realization of slabs of ceramic and/or stone material according to claim 10.

BRIEF DESCRIPTION OF THE DRAWINGS

Other characteristics and advantages of the present invention will become more evident from the description of a preferred but not exclusive embodiment of a process for the realization of slabs of ceramic and/or stone material, illustrated by way of a non-limiting example in the accompanying tables of drawings in which:

FIG. 4 is a schematic and partial representation of a piece of equipment for carrying out the process according to the invention during the deposition phase of the additional material;

FIG. 4*a* is an enlargement of a detail of the equipment of FIG. 4;

FIG. 5 is a schematic and partial representation of a piece of equipment for carrying out the process according to the invention during the movement phase of the additional material;

EMBODIMENTS OF THE INVENTION

Figure 1:
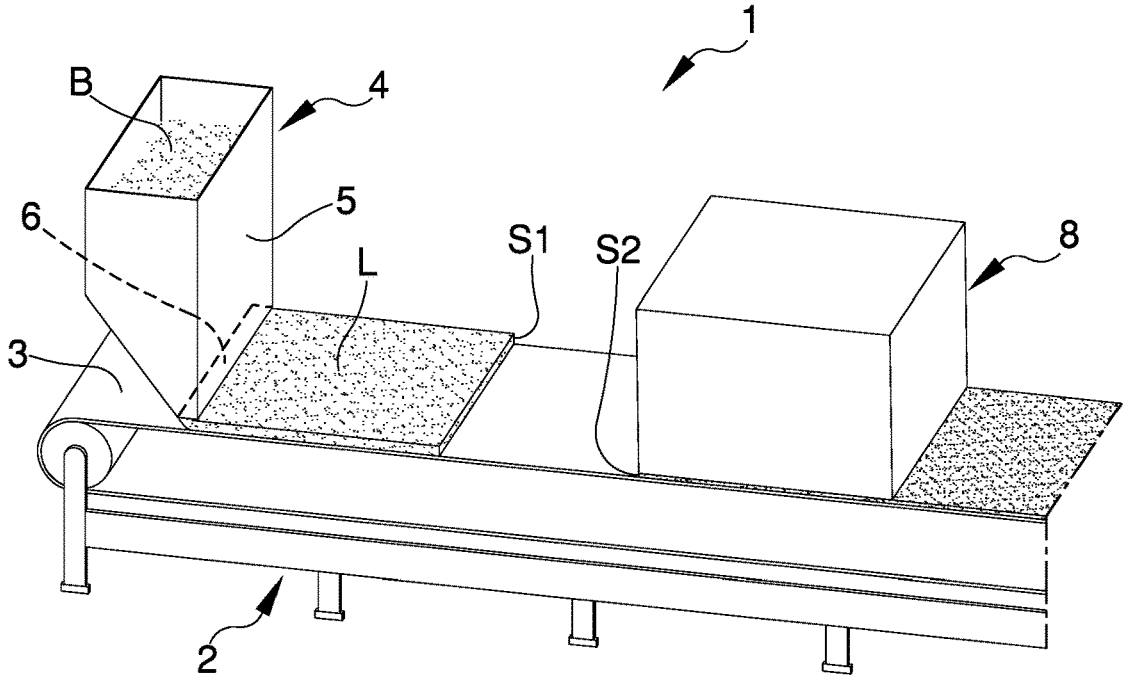
FIG. 1 is a schematic and partial representation of a piece of equipment for carrying out the process according to the invention during the deposition phase of the base material in a first embodiment.

With particular reference to these figures, reference numeral 1 globally indicates a piece of equipment for the realization of slabs of ceramic and/or stone material.

Figure 2:
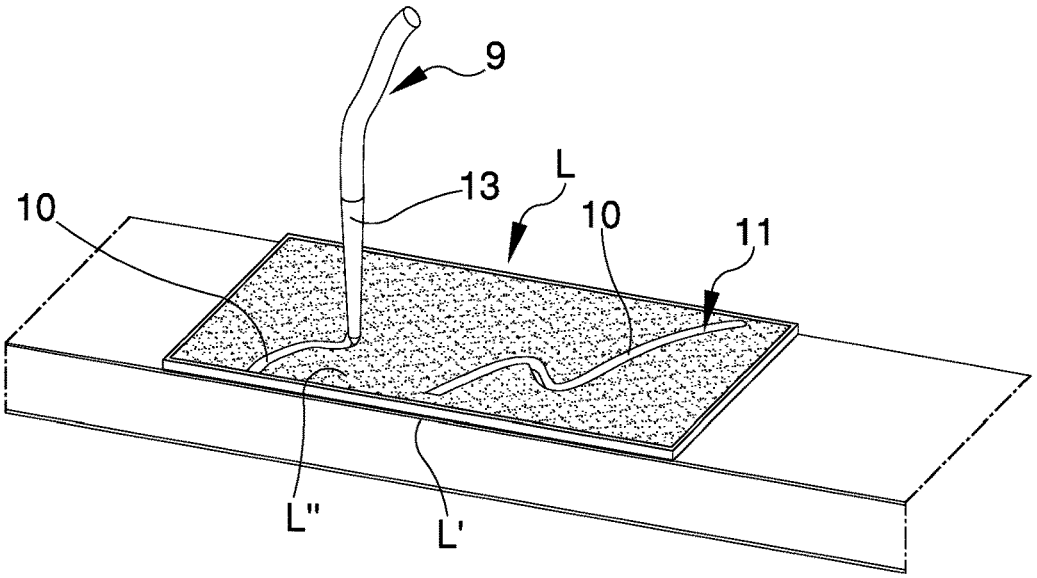
FIG. 2 is a schematic and partial representation of a piece of equipment for carrying out the process according to the invention during the suction phase of the base material in a second embodiment.
Figure 3:
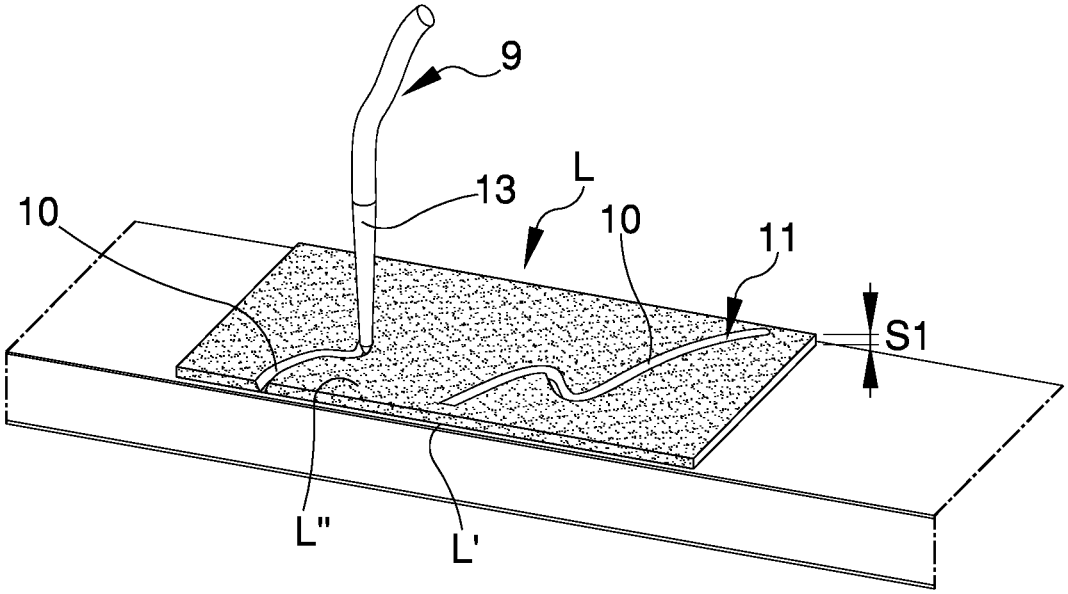
FIG. 3 is a schematic and partial representation of the equipment of FIG. 1 during the suction phase of the base material in a second embodiment.
Figure 3A:
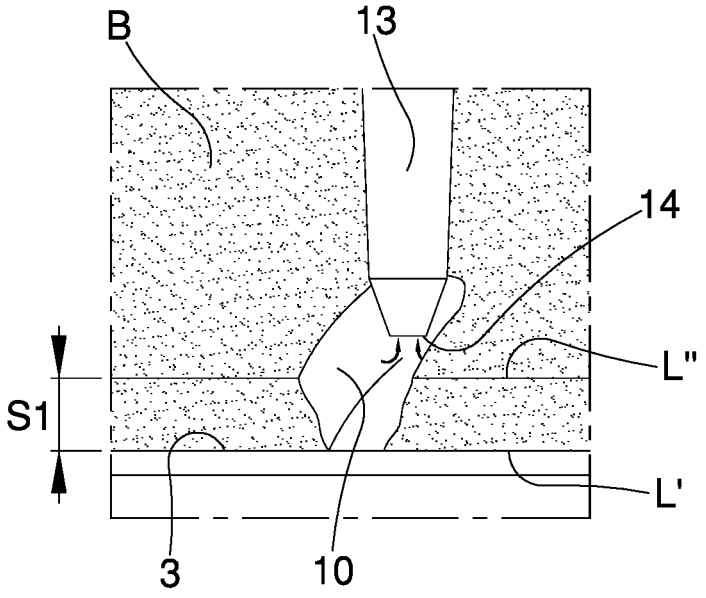
FIG. 3*a* is an enlargement of a detail of the equipment of FIG. 3.

The equipment 1 comprises a load-bearing frame 2 with which at least one supporting surface 3 is associated. More particularly, the supporting surface 3 is of the type of a belt (as shown in FIG. 1) or of the type of a mold (as shown in FIG. 2). The supporting surface 3 can also be moved along a direction of forward movement or, alternatively, of the fixed type.

The equipment 1 also comprises delivery means 4 of at least one base material B on the supporting surface 3 to obtain a slab to be compacted L having an initial thickness S1.

Advantageously, the delivery means 4 comprise at least one hopper 5 provided with an outlet port 6 extending along a delivery direction 7 and arranged on top of the supporting surface 3.

The base material B contained inside the hopper 5 can fall by gravity on the supporting surface 3 or a delivery device can be provided (not shown in detail in the illustrations), arranged inside the hopper itself and movable along the delivery direction 7, which is adapted to deliver the base material on the supporting surface 3. In turn, the hopper 5 can be fed by one or more extractor belts (not shown in the illustrations) adapted to extract the various materials to be introduced into the hopper itself.

The base material B can be of the ceramic type, in the form of atomized, grains or flakes, and/or stone (such as marble, granite, minerals or other natural stones), in the form of powder and/or granules and/or flakes and mixed with a binder of a cement or resin nature. The base material B may consist of a single type of material, or of a plurality of primary materials of different types and/or with different colors.

The base material B contained inside the hopper 5 can therefore have a substantially uniform grain size and coloring, or it can consist of a plurality of different materials, in terms of type and/or coloring, mixed together or superimposed to define a plurality of layers.

The slabs to be compacted L can therefore be of the ceramic type, therefore meant to undergo a firing process, or of the type of slabs in mineral grits (also called quartz slabs), meant to undergo a process of vibration-compression under vacuum.

The characteristics of the materials with which the slabs could be made, in any case, do not in any way constitute a limitation to the objects of the present invention.

The slab to be compacted L therefore has a face L' arranged resting on the supporting surface 3, which corresponds to the visible face of the finished slab, and a face L" facing upwards, which corresponds to the installation face of the finished slab.

The equipment 1 also comprises pressing means 8 of the slab to be compacted L, not shown in detail in the illustrations, to obtain a compacted slab C having a final thickness S2 which is smaller than the initial thickness S1.

The pressing means 8 generally provide for the presence of a buffer, adapted to apply a predefined force on the slab to be compacted, and of a counteracting element.

The pressing means 8 may vary in construction according to the type of material used and are of a type known to the expert in the field.

The pressing means 8 can be of the dynamic type (in particular in the event of the material used being of the ceramic type), i.e. they can comprise a pair of belts adapted to contact the opposite faces of the slab to be compacted L during its forward movement, where one of such belts acts as a buffer and the other as a counteracting element, or they can be of a static type, i.e. the buffer applies the pressing force on the slab to be compacted when it is stationary.

According to the invention, the equipment 1 comprises suction means 9 of at least one portion of the base material B from the slab to be compacted L so as to obtain at least one through groove 10 which crosses the initial thickness S1 along a determined path 11 and application means 12 of at least one additional material A, different from the base material B, inside the groove 10. The additional material A may be of a different type and/or color with respect to the base material B and may consist of a single material or of multiple materials mixed together.

The additional material A can also be of the ceramic and/or stone type and in the form of powder and/or granules and/or flakes.

Advantageously, the suction means 9 comprise at least a first tool 13 provided with at least one suction inlet 14 and movable with respect to the slab to be compacted L along the path 11.

The amount of the base material B sucked up varies according to the size and shape of the suction inlet 14.

The suction means 9 are therefore arranged upstream of the pressing means 8 with respect to the direction of forward movement of the slab to be compacted L.

More in particular, the first tool 13 is adapted to suck up a certain amount of base material B from the slab to be compacted L starting from the installation face L" so that the groove 10 crosses the entire initial thickness S1 reaching the visible face L'.

Appropriately, the first tool 13 can be moved either along a plane substantially parallel to the supporting surface 3 or in the direction of approach to/moving away from the supporting surface itself.

The path 11 along which the first tool 13 moves can be of the predefined or random type.

Preferably, the application means 12 comprise at least a second tool 15 provided with a delivery outlet 16 of the additional material A and movable with respect to the slab to be compacted L along the path 11.

More in detail, the second tool 15 is adapted to fill the groove 10 defined by the first tool 13 with the additional material A, so as to create a "vein" 20 of different color than the base material B.

Advantageously, the first and the second tool 13 and 15 move in a substantially synchronized manner with respect to each other along the path 11. In other words, while the first tool 13 sucks up the base material B from the slab to be compacted L, the second tool 15, which follows, simultaneously delivers the additional material A inside it.

More particularly, the first and the second tool 13 and 15 are associated with each other, where the second tool 15 is arranged after the first tool 13 (meaning by this definition that it follows the first tool 13), with respect to their direction of forward movement along the path 11.

In an alternative embodiment, not shown in the illustrations, the equipment 1 comprises means for compacting the slab to be compacted, placed between the delivery means 4 and the pressing means 8, which are adapted to intervene after the first tool 13 and before the second tool 15. The compacting means are therefore adapted to compact the slab to be compacted L, thus reducing its thickness, after the definition of the groove 10 and before the latter is filled with the additional material A.

Conveniently, at least one of the first and the second tools 13 and 15 comprises at least adjustment means 17 of the transit section of the air and of the additional material A, respectively.

More in detail, the first tool 13 can be provided with adjustment means 17, e.g. of the type of a gate or the like, which can be activated to allow/prevent or choke the transit of the air coming out of the suction inlet 14.

Similarly, the second tool 15 can be provided with relative adjustment means 17 which can be activated to allow/prevent or choke the flow of the additional material A which comes out of the delivery outlet 16.

Preferably, the equipment 1 also comprises at least a third tool 18, movable at least in the direction of approaching to/moving away from the supporting surface 3 to penetrate inside the slab to be compacted L and movable with respect to the supporting surface itself to drag the additional material A through the base material B. The third tool 18 is therefore adapted, with its movement, to mix the base material B together with the additional material A in order to create particular aesthetic effects, e.g. obtaining an irregular and/or shaded appearance of the vein 20 defined by the additional material A deposited inside the groove 10.

More in detail, the third tool 18 has one end adapted to penetrate inside the slab to be compacted L and provided with a plurality of flanges 18*a* separate from each other. The flanges 18*a* may be of different shape the one from the other, e.g., they may have pointed, flattened, rounded, or similar shape, and they may have different stiffness, so as to vary the way in which the material is dragged following impact with the same.

In the exemplary embodiment shown in the figures, the flanges 18*a* of the third tool 18 are angularly spaced apart from each other.

Advantageously, the third tool 18 is movable with respect to the slab to be compacted L along the path 11.

Figure 5A:
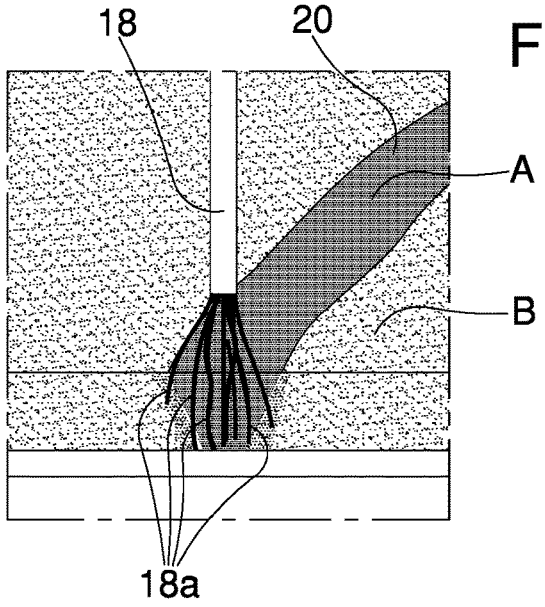
FIG. 5*a* is an enlargement of a detail of the equipment of FIG. 5.

In the particular embodiment schematically shown in FIG. 5, the equipment 1 comprises at least one load-bearing structure 19, e.g., bridge-shaped, associated with the frame 2, supporting the third tool 18 and movable along a sliding direction 21. In turn, the third tool 18 is movable with respect to the load-bearing structure 19 in approach to/moving away from the supporting surface 3 and along a plane substantially parallel to the supporting surface itself.

Conveniently, the third tool 18 can move substantially simultaneously to the first tool 13 and/or to the second tool 15. The movement of the tools 13, 15 and 18 along the path 11 is therefore synchronized.

More specifically, the first, second and third tools 13, 15 and 18 are associated with each other, where the third tool 18 is arranged after the second tool 15 (meaning by this definition that it follows the second tool 15) with respect to their direction of forward movement along the path 11. In other words, while the first tool 13 sucks up the base material B from the slab to be compacted L, the second tool 15 delivers, at the same time, the additional material A inside it and the third tool 18, which follows, moves the additional material A so deposited.

In this embodiment, the tools 13, 15 and 18 are best spaced out from each other so as not to interfere with each other.

Preferably, at least one of the tools 13, 15 and 18 can be moved along the path 11 by means of an articulated arm provided with at least 3 degrees of freedom. Advantageously, the equipment 1 comprises at least one electronic central unit, not shown in the illustrations, provided with at least one command and control unit operatively connected to at least one of the tools 13, 15, 18 to command the displacement thereof along the path 11.

More in detail, the command and control unit can be operationally connected to a programmable memory with the path 11, e.g., by importing a drawing in electronic format or by scanning an existing slab, the aesthetic effect of which is to be reproduced.

Alternatively, or in addition to the presence of a programmable memory, the command and control unit can be operationally connected to command means which can be manually operated by an operator, e.g., of the joystick type.

The operation of the equipment in carrying out the process according to the invention is as follows.

The process, to which the present invention relates, provides first of all a supply phase of the base material B and of the additional material A according to what described above.

The supply of the base material B can involve loading a single type of material into the hopper 5 or, alternatively, mixing at least two primary materials of the ceramic and/or stone type in the form of powder and/or granules and/or flakes. Subsequently, the base material B is deposited on the supporting surface 3 in order to obtain a slab to be compacted L with an initial thickness S1.

More specifically, the deposition of the base material B on the supporting surface 3 occurs by dropping the base material itself through the outlet port 6 by gravity or through a delivery device contained inside the hopper itself and not shown in the illustrations.

According to the invention, the phase of deposition of the base material B is followed by a suction phase of a portion of the base material itself in order to obtain a through groove 10. The groove 10 thus obtained crosses the entire initial thickness S1 of the slab to be compacted L starting from the installation face L" up to the visible face L'. The groove 10 therefore uncovers a corresponding portion of the supporting surface 3.

The suction phase is carried out by means of the first tool 13 which, by moving along the path 11 and approaching to/moving away from the supporting surface 3, removes, through the suction inlet 14, a part of the base material B which makes up the slab to be compacted L.

As mentioned above, the path 11 can be of the preset type (e.g., in the case where the first tool 13 is moved following a series of predefined coordinates), of the random type (e.g., in the case where the first tool 13 is moved without following a predefined design), or decided from time to time manually by an operator.

After the suction phase, the additional material is applied to the inside of the groove 10 in order to define a "vein" 20 of a different color and/or type from the base material B.

More specifically, the additional material A is applied inside the groove 10 by a thickness substantially equal to the initial thickness S1.

The application of the additional material A is done using the second tool 15. Preferably, the application phase of the additional material A is carried out immediately after the suction phase. In more detail, the second tool 15 moves at the same time as the first tool 13 so that the additional material A is dispensed immediately after the first tool 13 has sucked up the base material B to define the groove 10. Because, following suction, the base material placed at the installation face L" tends to slide downwards, thus defining a V profile of the groove 10, the fact that the additional material A is dispensed immediately after the suction phase permits reducing the width of the angle defined by the opposite walls of the groove 10, so as to obtain a more uniform vein 20.

In this embodiment, the process according to the invention can further comprise, after the application of the additional material A, at least one smoothing phase of the base material B and of the additional material A applied inside the groove 10 in order to make the initial thickness S1 substantially uniform.

In an alternative embodiment, after the suction phase and before the application phase, a compaction phase of the base material B is carried out to obtain an intermediate thickness. This compaction permits reducing the amount of the base material B placed at the installation face L' which slides inside the groove 10 towards the supporting surface 3. The application of the additional material A after compaction is carried out in such a way that the thickness of the additional material itself is substantially equal to the initial thickness S1. This is necessary because the additional material A applied in this way, not having been compacted, has a different density from the base material B, which makes up the remaining part of the slab to be compacted L'.

The movement of the first tool 13 and of the second tool 15 is managed by the electronic central unit, which controls the movement thereof according to a preset drawing or according to the manual inputs of an operator.

Advantageously, after the phase of application of the additional material A, a phase of movement of the additional material itself is carried out. Such movement is carried out by means of the third tool 18 which, with its flanges 18*a*, drags the additional material A along different directions, mixing it with the base material B, in order to obtain varied decorative effects. Appropriately, the third tool 18 is moved substantially (in the sense that it may not follow in a slavish way) along the path 11, approaching to/moving away from the supporting surface 3.

In the same way as the first and second tools 13 and 15, the movement of the third tool 18 is also managed by the electronic central unit.

Figure 6:
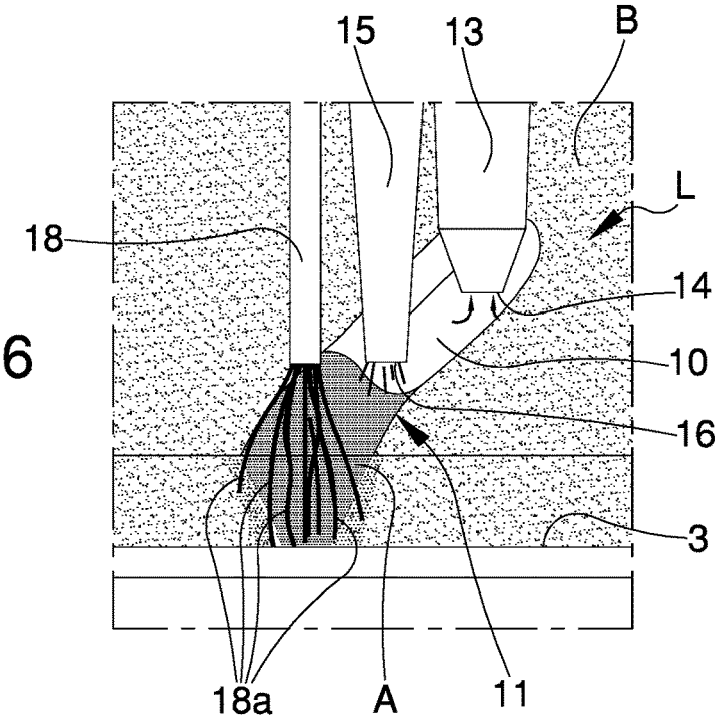
FIG. 6 is a schematic representation of the tools of a piece of equipment according to the invention in a particular embodiment.
Figure 7:
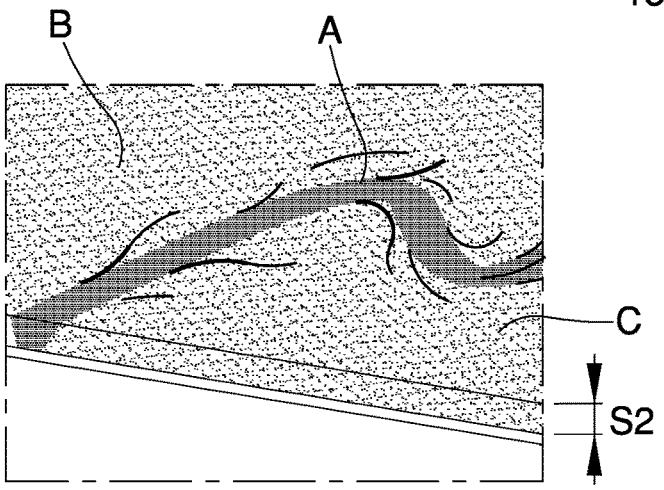
FIG. 7 is a schematic representation of a compacted slab obtained with the process according to the invention.

In the preferred embodiment shown in FIG. 6, the third tool 18 is moved in a synchronized manner, to the first tool 13 and to the second tool 15.

After the application of the additional material A, and after its movement, where this phase is foreseen, the slab to be compacted L is pressed, including both the base material B and the additional material A delivered inside the groove 10, in order to obtain a compacted slab C with a final thickness S2 lower than the initial thickness S1. The pressing phase is carried out by means of the pressing means 8.

It has, in practice, been ascertained that the process described above, as well as the relative equipment, achieves the intended objects and, in particular, the fact is underlined that it permits obtaining slabs with a wide variety of veins and aesthetic effects in a practical and easy way.

In particular, the possibility of defining at will the path of the grooves that create the veins and of being able to introduce into them materials of different types and/or colors, permits both reproducing any type of known aesthetic effect and obtaining new aesthetic effects.

The process and the equipment according to the invention permit both reproducing the aesthetic effect of natural stones, such as marble and granite, for example by scanning existing slabs, and creating innovative and creative aesthetic solutions not present in nature and not obtainable otherwise.

This is particularly possible because of the freedom of movement of the tools for the extraction of the base material and for the delivery of additional material along a plane.

The invention claimed is:

1. An equipment for the realization of slabs of ceramic and/or stone material, including:

a load-bearing frame;

at least one supporting surface associated with said load-bearing frame;

delivery means of at least one base material of the ceramic and/or stone type in the form of powder and/or granules on said supporting surface to obtain a slab to be compacted having an initial thickness;

pressing means of said slab to be compacted to obtain a compacted slab having a final thickness which is smaller than said initial thickness;

wherein the equipment comprises suction means of at least one portion of the base material from said slab to be compacted so as to obtain at least one through groove which crosses said initial thickness along a determined path and application means of at least one additional material, different from said base material, inside said groove to define at least one vein of a color and/or type which is different from said base material, and wherein said suction means comprise at least a first tool provided with at least one suction inlet and movable with respect to said slab to be compacted along said path and said application means comprise at least a second tool provided with a delivery outlet of the additional material and movable with respect to said slab to be compacted along said path, wherein at least one of said first tool and said second tool can be moved along said path by means of articulated arm provided with at least 3 degrees of freedom;

at least one electronic central unit provided with at least one command and control unit operatively connected to at least one of said first tool and said second tool to command the displacement thereof along said path, and wherein said command and control unit being operationally connected to a programmable memory with said path by importing a drawing in electronic format or by scanning an existing slab, the aesthetic effect of which is to be reproduced, and to command means which can be manually operated by an operator.

2. The equipment according to claim 1, wherein said first and second tools move in a substantially synchronized manner relative to each other along said path.

3. The equipment according to claim 1, wherein said second tool is arranged after said first tool, with respect to the direction of forward movement along said path and adjacent thereto.

4. The equipment according to claim 1, wherein at least one of said first and second tools comprises at least adjustment means of the transit section of the air and of the additional material, respectively.

5. The equipment (1) according to claim 1, wherein said equipment comprises at least a third tool, movable at least in the direction of approaching to/moving away from said supporting surface to penetrate inside said slab to be compacted and movable with respect to the supporting surface itself to move said additional material through said base material.

6. The equipment according to claim 5, wherein said third tool has one end, intended to penetrate inside said slab to be compacted, provided with a plurality of flanges separate from each other.

7. The equipment according to claim 5, wherein said third tool is movable along said path.

8. The equipment according to claim 7, wherein said third tool is movable substantially simultaneously to said first tool and to said second tool along said path, said third tool being arranged after said second tool with respect to the direction of forward movement along said path.

* * * * *